US006959633B2

(12) United States Patent
Brady

(10) Patent No.: US 6,959,633 B2
(45) Date of Patent: Nov. 1, 2005

(54) CUTTING SYSTEM

(76) Inventor: Richard J. Brady, 183 E. Highway 54, Camdenton, MO (US) 65020

( * ) Notice: Subject to any disclaimer, the term of this patent is extended or adjusted under 35 U.S.C. 154(b) by 5 days.

(21) Appl. No.: 10/349,533

(22) Filed: Jan. 23, 2003

(65) Prior Publication Data

US 2003/0110916 A1 Jun. 19, 2003

Related U.S. Application Data

(63) Continuation-in-part of application No. 09/652,769, filed on Aug. 31, 2000, now abandoned.

(51) Int. Cl.[7] ..... B26D 7/27

(52) U.S. Cl. ..... 83/522.19; 83/468.7; 83/522.25; 83/468.2

(58) Field of Search ..... 83/522.19, 692, 83/522.25, 522.17, 468.7, 464, 636, 633, 581, 468.6, 468.2, 468.1, 465, 917

(56) References Cited

U.S. PATENT DOCUMENTS

| | | | | | |
|---|---|---|---|---|---|
| 2,613,740 | A | | 10/1952 | Drain | |
| 3,059,674 | A | * | 10/1962 | Boling | 83/468 |
| 3,065,657 | A | | 11/1962 | Thompson | |
| 3,227,025 | A | | 1/1966 | MacMillan | |
| 3,807,269 | A | * | 4/1974 | Mertes | 83/468 |
| 4,092,005 | A | | 5/1978 | Benroth | |
| 4,111,088 | A | | 9/1978 | Ziegelmeyer | |
| 4,481,848 | A | | 11/1984 | Ikeda | |
| 4,567,802 | A | | 2/1986 | Witherspoon | |
| 4,903,409 | A | * | 2/1990 | Kaplan et al. | 30/293 |
| 4,930,384 | A | | 6/1990 | Nakatsuji | |
| 4,970,925 | A | | 11/1990 | Nakatsuji | |
| 5,685,212 | A | | 11/1997 | Licata et al. | |
| 5,943,933 | A | | 8/1999 | Evans et al. | |
| 6,128,993 | A | * | 10/2000 | Zach | 83/453 |
| 6,226,885 | B1 | * | 5/2001 | Korich | 33/760 |
| 6,324,766 | B1 | * | 12/2001 | Schooley | 33/42 |

FOREIGN PATENT DOCUMENTS

| | | |
|---|---|---|
| CA | 2137706 | 10/1996 |

* cited by examiner

*Primary Examiner*—Allan N. Shoap
*Assistant Examiner*—Omar Flores Sánchez
(74) *Attorney, Agent, or Firm*—Polster, Lieder, Woodruff & Lucchesi, L.C.

(57) ABSTRACT

A cutting system for accurately cutting a notch in a piece of lineal to permit sharp bending of the lineal, permitting the lineal to be placed about the perimeter of picture or similar structure is disclosed. The cutting system includes a handle for driving a cutting blade in the direction of the force of gravity, and includes a retracting mechanism to return the handle and cutting blade to an initial starting position after each cut. A laterally reversible measuring assembly consisting of a measuring guide barn and a pair of adjustable measuring stops for measuring and supporting a piece of lineal to be cut, is releasably secured to the cutting system, facilitating interchange between left and right lateral configurations.

11 Claims, 10 Drawing Sheets

CUTTING SYSTEM

CROSS-REFERENCE TO RELATED APPLICATIONS

This application is a continuation-in-part application, based upon U.S. patent application Ser. No. 09/652,769 filed on Aug. 31, 2000 now abandoned.

STATEMENT REGARDING FEDERALLY SPONSORED RESEARCH

Not Applicable.

BACKGROUND OF THE INVENTION

This invention relates to cutting devices, and more particularly, to cutting devices adapted to cut plastic edging used as a border around various articles, such as foam board mounted exhibits, mounted photographs, signs, plaques, and the like. While the invention is described with particular reference to those applications, those skilled in the art will recognize the wider applicability of the inventive principles disclosed hereinafter.

Techniques for cutting plastic or metal edging which is then placed around the second article, such as a foam board mounted exhibit, mounted photograph, sign or plaque, are well known. The plastic edging, commonly referred to as lineals in the trade, normally has a J or U-shaped channel formed in it, which is designed to receive the edge of the item encased. One particular apparatus accomplishing that function is disclosed in U.S. Pat. No. 5,943,933 to Evans et al. (the '933 patent). The '933 patent discloses a cutting mechanism which is mounted on a base member. The base member is placed on a work surface, such as a table, and a cutting operation is performed. While the apparatus disclosed in the '933 patent works for its intended purpose, review of that patent shows that the handle or actuating mechanism is difficult to operate. This difficulty results from the fact that the force applied to the handle is done in a horizontal plane parallel to the plane of the table top or other work surface, for example. The result is that when sufficient pressure is applied to activate the handle, the entire machine is likely to slide, twist, and rotate. This makes it necessary for the operator to offset the momentum by attempting to "hold the machine steady". Because it is necessary to apply equal and opposite pressure to the base of the device, the device is awkward to use and hard to operate. Repeated use often results in operator fatigue. That fatigue may lead to carpal tunnel injury.

In addition, because the actuating mechanism disclosed in the '933 patent is positioned laterally from the cutting mechanism, the associated measurement mechanism disclosed in the '933 patent can only be attached to the device on the opposite side of the cutting mechanism, and is not interchangeable from left to right. This severely limits the application of the apparatus in operational use. For example, because the measuring system of the '933 patent only can be attached along the right hand side of the cutting mechanism the device operates only as a right-handed device, limiting its usefulness of the device for left-handed operators. In addition, the construction limits the unit's logistical location in a work environment where space is at a premium, and where there may not be a work space that allows the lineals to be cut from left to right.

Accordingly, there is a need in the industry for a lineal cutting tool configured with an adjustable measuring system to permit the operator to configure the cutting tool to accept the lineals from either left to right, or from right to left. Equally important is the need in the industry for a cutting mechanism which is actuated in a plane perpendicular to the adjustable measuring system, and in a direction corresponding to the direction of the force of gravity, regardless of the orientation of the device to which the cutting mechanism is mounted, thereby avoiding the application of a rotating or twisting torque on the cutting mechanism during use.

BRIEF SUMMARY OF THE INVENTION

Among the several objects and advantages of the present invention are:

One of the objects of the present invention is to provide a cutting mechanism that cuts notches into various shaped lineal material.

Another object of the present invention is to provide a cutting device that is easy to operate.

Another object of the present invention is to provide a cutting mechanism which has a force actuator that operates in the direction of force of gravity.

Another object of the present invention is to provide a design which compounds the leverage during operation to give an operator the greatest amount of force with the least amount of effort.

Another object of the present invention is to provide an ergonomic design for a cutter mechanism.

Another object of the present invention is to provide a cutting mechanism in which the force actuating handle is returned automatically to a start position.

Still another object of the present invention is to provide a cutting mechanism which enables the same mechanism to be utilized across a series of model lines.

Another object of the present invention is to provide a cutting mechanism which may be stand mounted, the stand including a storage system for lineals and other related supplies employed with the cutting device.

Another object of the present invention is to provide a stand model cutter having adjustable legs to accommodate different operator heights.

Another object of the present invention is to provide a cutting mechanism configured with a bilateral adjustable measuring system to permit a operator to configure the cutting tool to accept lineals from left to right, or from right to left.

Another object of the present invention is to provide a cutting mechanism configured with a quick change bilateral adjustable measuring system.

Another object of the present invention is to provide a cutting mechanism configured with an measuring system having adjustable lineal guides.

Other objects of the present invention will be apparent to those skilled in the art in light of the foregoing description and accompanying drawings.

In accordance with this invention, generally stated, a mechanism for cutting a workpiece includes a base member having a receptacle for receiving the workpiece, a clamping device to hold the workpiece in place, and a cutting blade shaped to provide the desired cut in the workpiece. The mechanism includes a measuring system which may be positioned on the base in at least two opposed lateral positions. A lever is operatively connected to the cutting blade, and the system is designed so that the lever operates or is activated in the direction of the force of gravity. The mechanism further includes a system for automatically returning the lever to its operating position.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
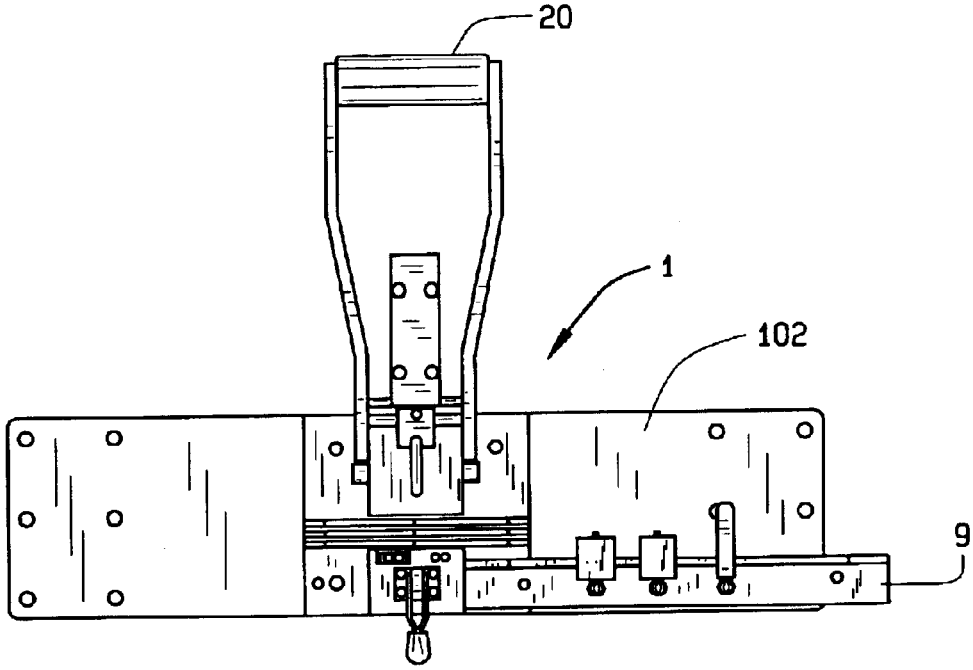
FIG. 1 is a front plan view of a wall mounted embodiment of the present invention.
Figure 2:
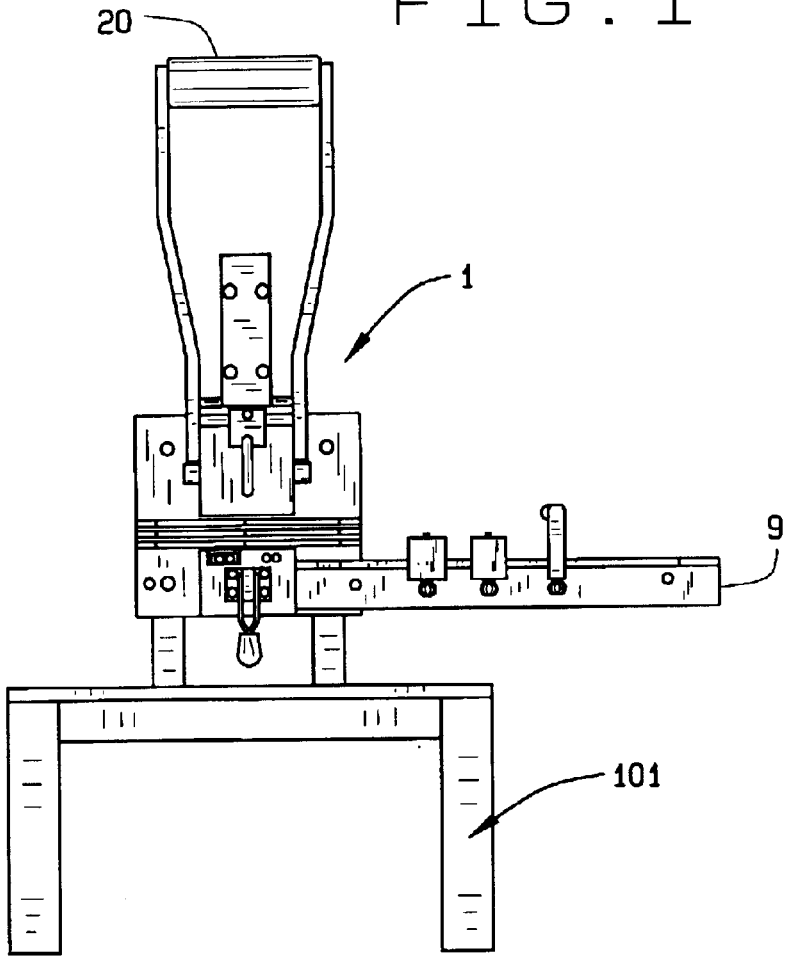
FIG. 2 is a front plan view of a desktop embodiment of the present invention.
Figure 3:
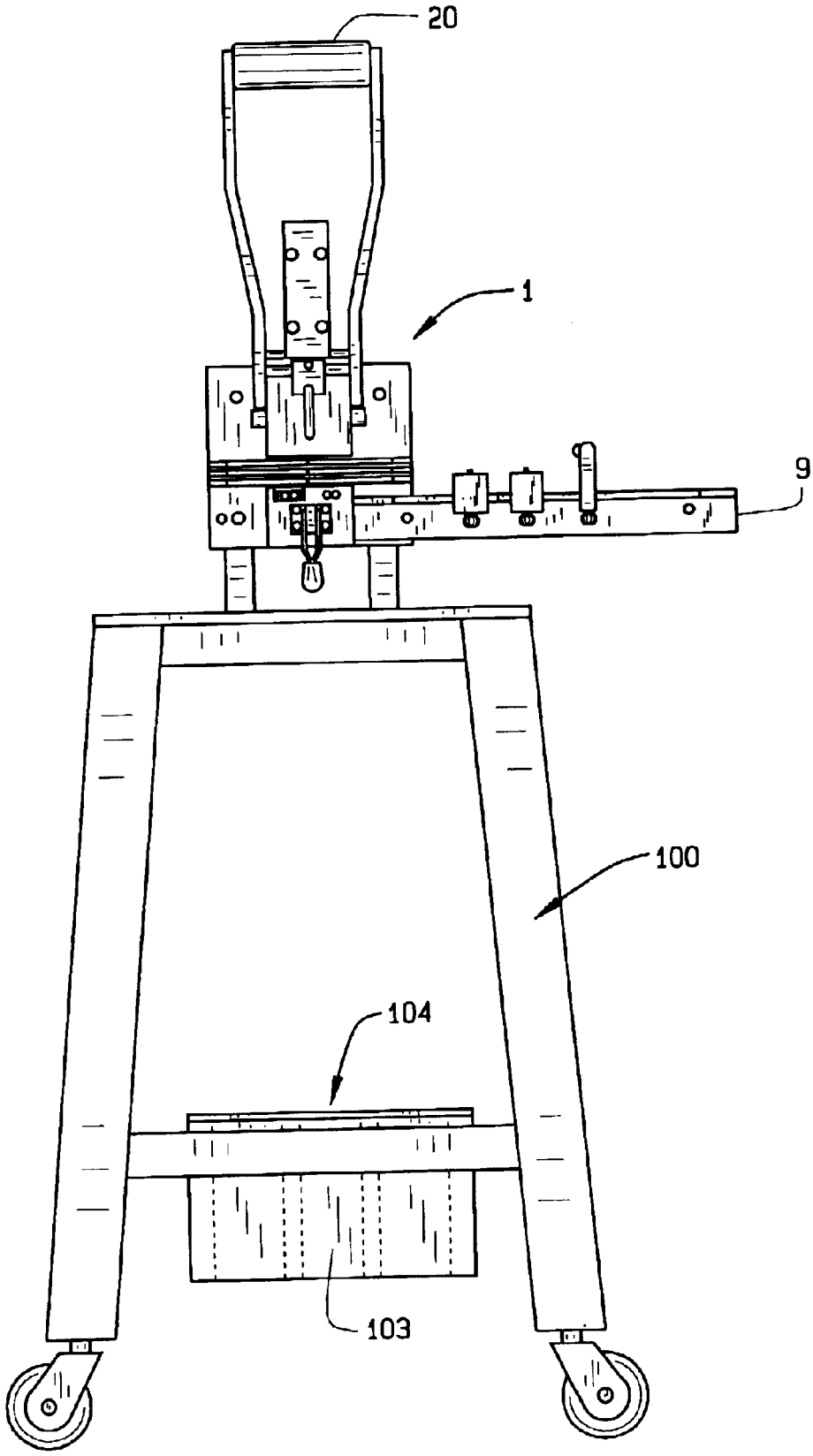
FIG. 3 is a front plan view of a stand-mounted embodiment of the present invention.

Referring now to FIGS. 1–3, reference numeral 1 indicates one illustrative embodiment of cutting mechanism of the present invention. While the invention is shown FIGS. 1–3 in three embodiments, the cutting mechanism assembly 1 is substantially the same in each of the embodiments. The cutting mechanism shown in FIG. 1 is intended for wall mounting. The device shown in FIG. 2 is a desktop model, and is attached to a desktop stand 101. The device shown in FIG. 3 is floor stand mounted model and is shown attached to a floor stand 100. It is an important feature of the present invention that the same cutting mechanism is used across the product line.

Figure 4:
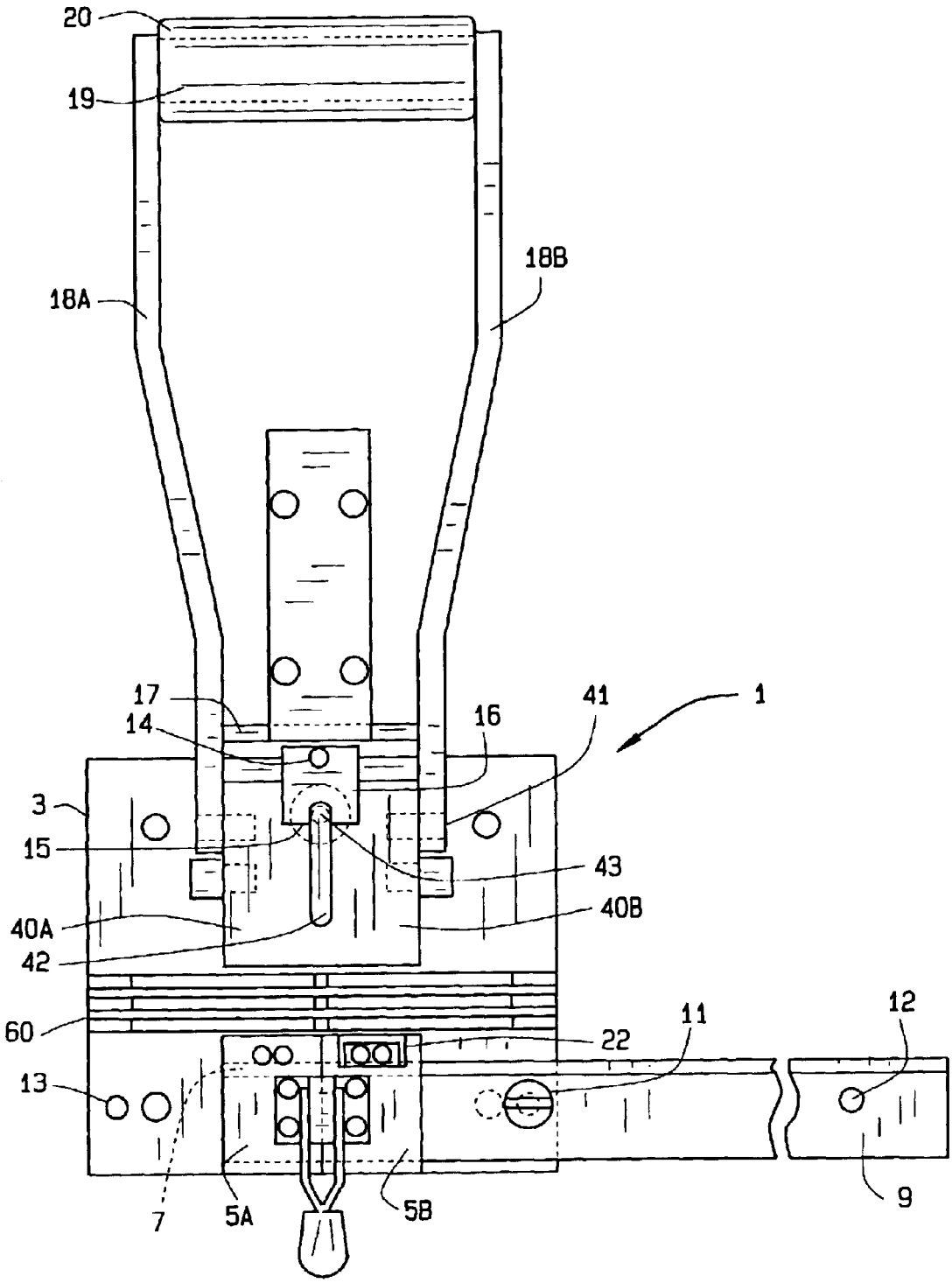
FIG. 4 is a front plan view of the cutting mechanism employed with the device as shown in FIGS. 1–3.

Referring now to FIG. 4, a base plate 3 of the assembly 1 has two shear blocks 5*a* and 5*b* attached to it. Attachment may be made by any convenient method. Shear blocks 5*a* and 5*b* have a channel 7 formed in them, which is sized to receive a measuring system 9. In the embodiment illustrated, the channel 7 extends through the blocks 5*a* and 5*b*, and is intended to receive left or right ends of the measuring system 9. The measuring system 9 is described in greater detail hereinafter. It is here noted, however, that the measuring system 9 may be attached to the shear blocks 5*a* and 5*b* from either the left or right side of the assembly 1. The measuring system 9 is shown mounted on the right side of the shear block 5*b* in FIGS. 1–4. The measuring system 9 is positioned along the blocks 5*a* and 5*b* and the base plate 3 by a lock mechanism 11, which fits through an opening 12 in the measuring system 9 and into a corresponding opening 13 in the base plate 3.

Figure 6:
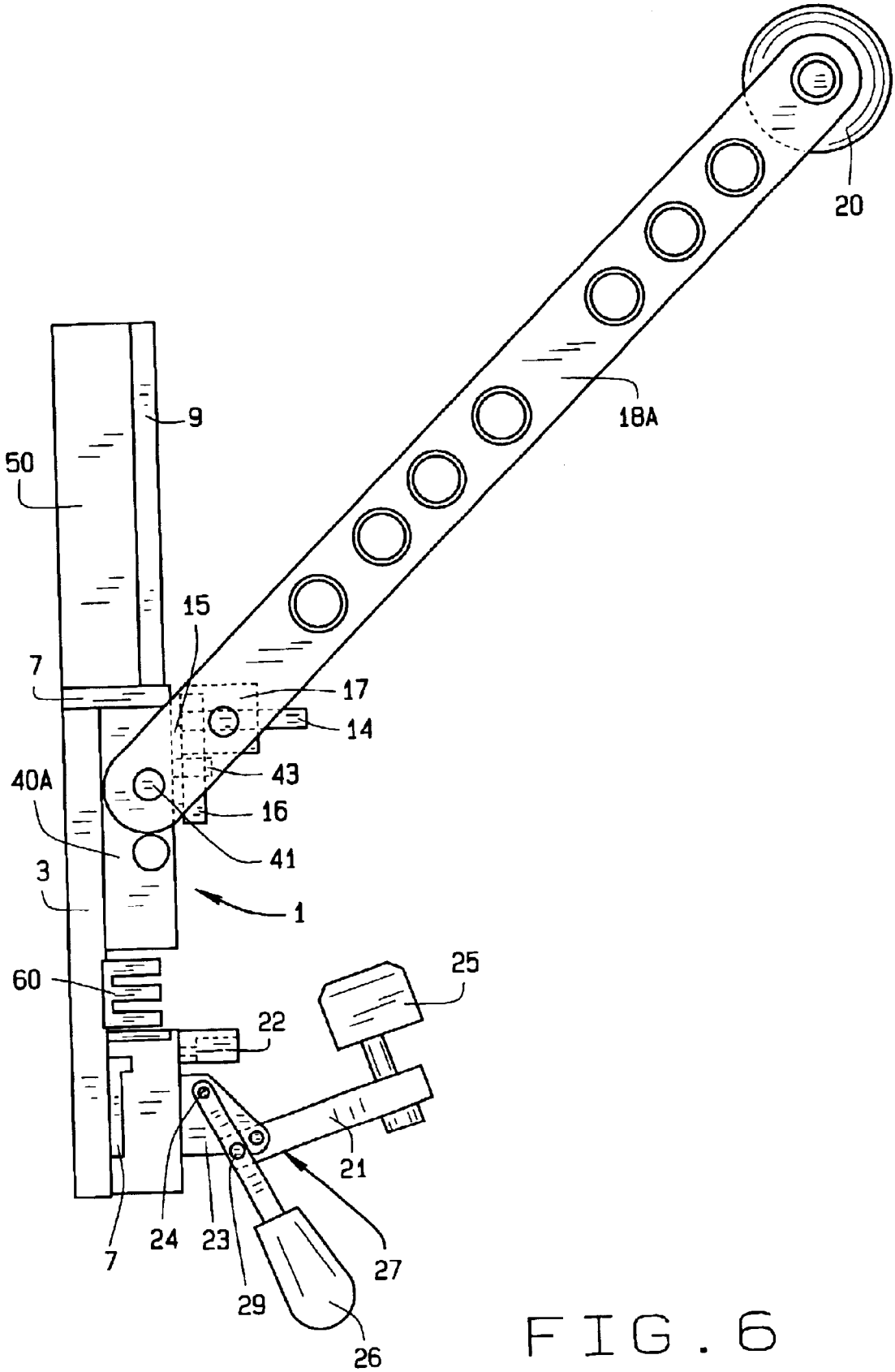
FIG. 6 is a view in side elevation of the mechanism shown in FIG. 4.

A clamp 27 (shown in FIG. 6) also is attached to the shear blocks 5*a* and 5*b* by any convenient method. Conventional threaded fasteners work well, for example. Those skilled in the art will recognize other mounting devices may be employed, if desired. As shown in FIG. 6, the clamp 27 includes a handle 26 which is pivotally mounted to a support 23 at a pivot point 24. An arm 21 is attached to the handle 26 at a connection point 29 and moves with the handle 26, about the pivot point 24. The arm 21 has a hold down 25 associated with it, which is utilized to clamp a suitable lineal, not shown, or other form of workpiece, in position on a jig 60. Jig 60 is mounted to the base 3 in any convenient method. Preferably, the jig 60 is removable and interchangeable, so that other forms of lineals and corresponding fixtures or jigs may be utilized with the cutting mechanism of the present invention.

A handle assembly 20, having a pair of arms 18*a* and 18*b*, is pivotally mounted to guide blocks 40*a* and 40*b* at a pivot point 41. Guide blocks 40*a* and 40*b* in turn are mounted to the base plate 3. Again, mounting may be made in any convenient manner. As best shown in FIG. 6, the arms 18*a* and 18*b* are mounted for rotation about the pivot point 41.

Figure 13:
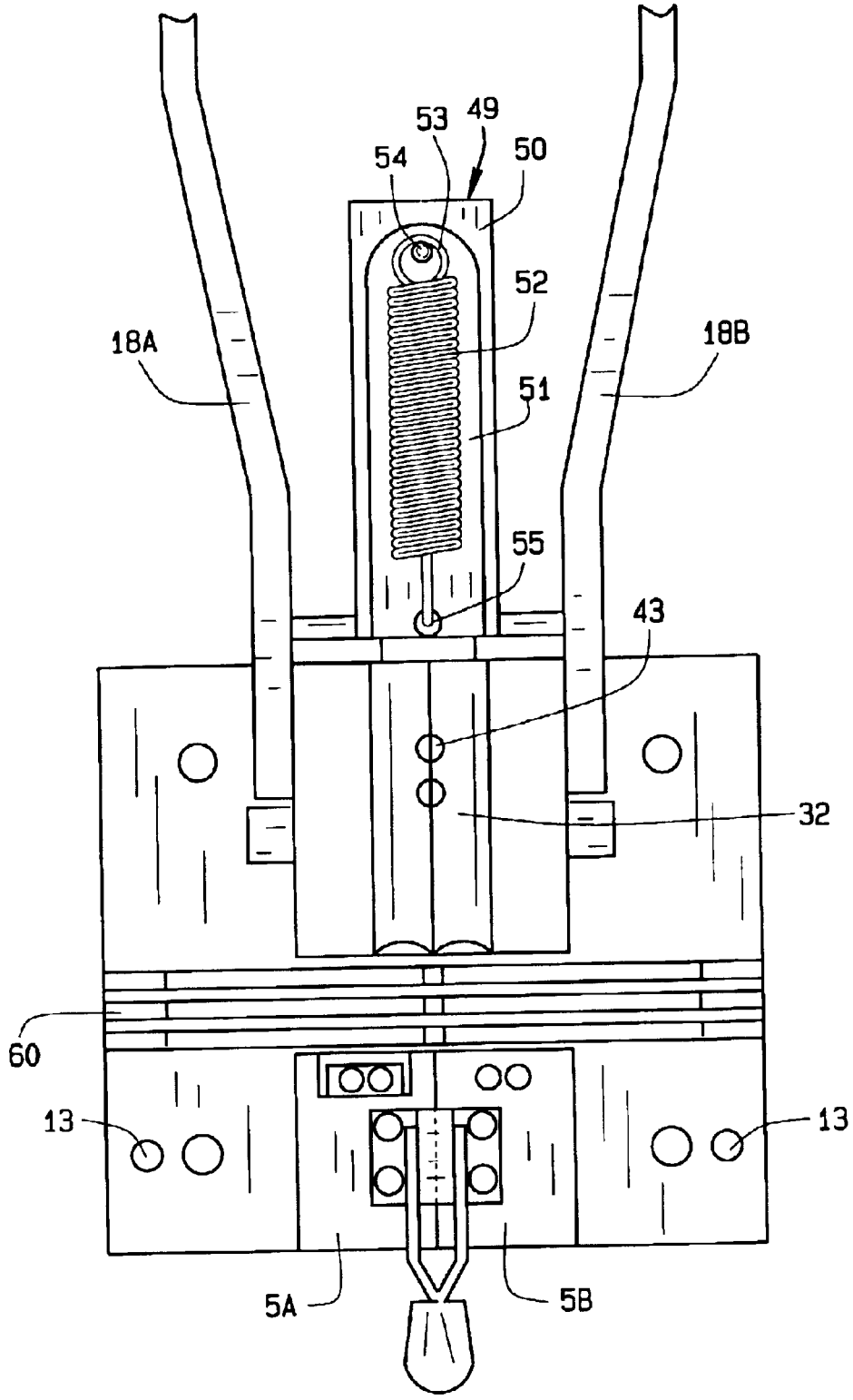
FIG. 13 is one illustrative embodiment of a return mechanism employed with the cutting mechanism of the present invention.

Referring now to FIG. 4 the guide blocks 40*a* and 40*b* have a channel 42 formed in them, which receives a pin 43 and guides the pin during movement of a cutting blade 32 (FIG. 13). The blade 32 is connected to a cam 16 which is driven by a cross bar device 17 during rotation of the handle assembly 20.

Figure 8:
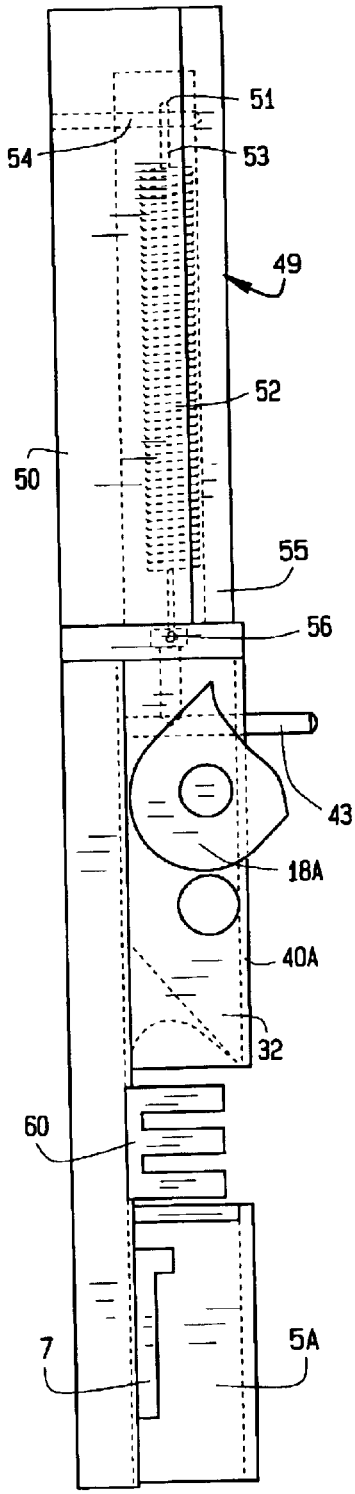
FIG. 8 is a view in side elevation, partly broken away, of the actuating mechanism employed with FIG. 4.

Referring to FIG. 8, a return mechanism assembly 49 is mounted to the guide blocks 40*a* and 40*b*. Return mechanism 49 includes a housing 50 having a channel 51 formed in it. In the embodiment illustrated, the channel 51 has a spring 52 positioned in it. The spring 52 has a first end 53 attached to a rod 54 and a second end 55 is attached to and operatively associated with a pin 56.

Figure 9:
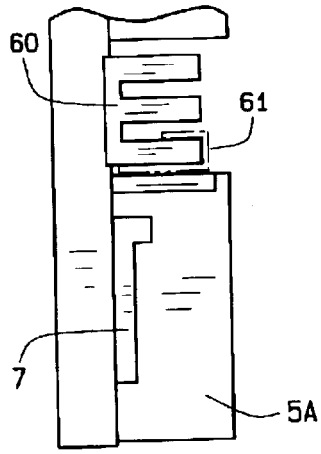
FIG. 9 is a view in side elevation, partly broken away, of a first side J-shaped lineal positioned for cutting.
Figure 10:
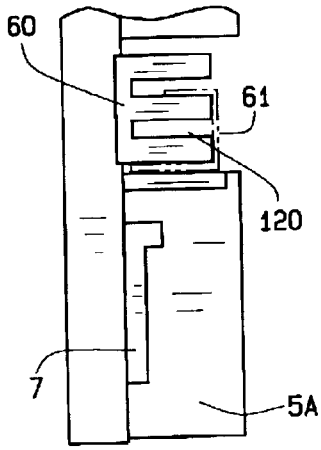
FIG. 10 is a view in side elevation, showing a second J-shaped lineal positioned for cutting.
Figure 11:
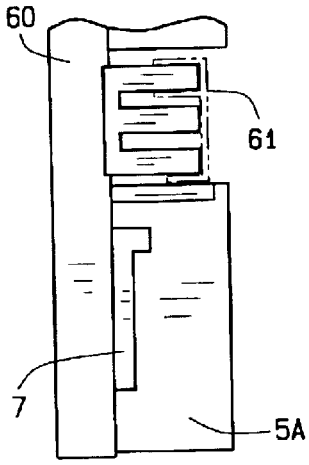
FIG. 11 is a view in side elevation of a E-shaped lineal positioned for cutting.

Jig 60, as seen in FIGS. 4 and 6–11, is intended to receive any one of the number of lineals 61. The lineals 61 are shown in dash lines in FIGS. 9–11. Lineals 61 may have varying widths between wall defining a receiver portion 120, as shown in FIG. 9 and 10. Lineals 61 may have a U-shaped or J-shaped configuration as shown in FIG. 9 and FIG. 10, or may have an E-shaped configuration as shown in FIG. 11. The jig 60 is designed to accommodate any of the lineals 61, without further modification. As indicated above, however, the jig 60 may be made removable from the base plate 3 and jigs having configurations other than those shown may be employed with the cutting mechanism assembly 1 of the present invention.

Figure 12:
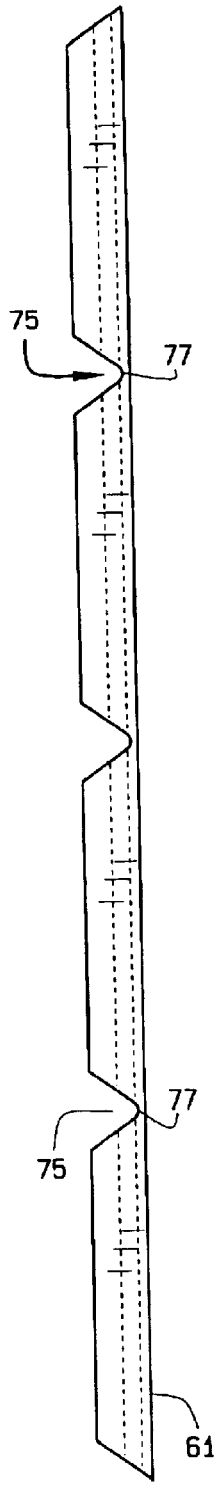
FIG. 12 is a top view of a J-shaped lineal, illustrating the notches made by the cutting mechanism of the present invention.

In any event, FIG. 12 illustrates the cuts made by blade 32 in a lineal 61. As shown in FIG. 8, the blade 32 is V-shaped in a cross section, and produces a V-shaped cut 75 in the lineal 61. Each cut has a carrier portion 77 between successive cuts. The carrier portion 77 permits the lineal 61 to be folded about a picture frame or the like in a conventional manner.

Figure 5:
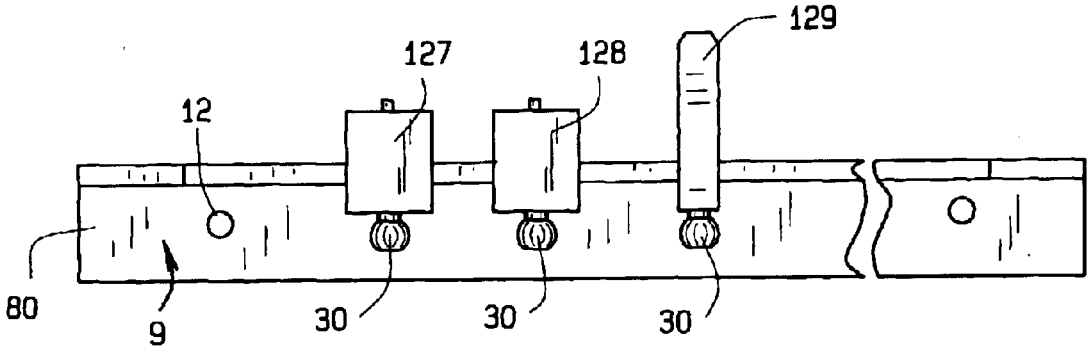
FIG. 5 is a view in side elevation, partly broken away, of a first measuring system employed with the device of FIG. 1–3.
Figure 7:
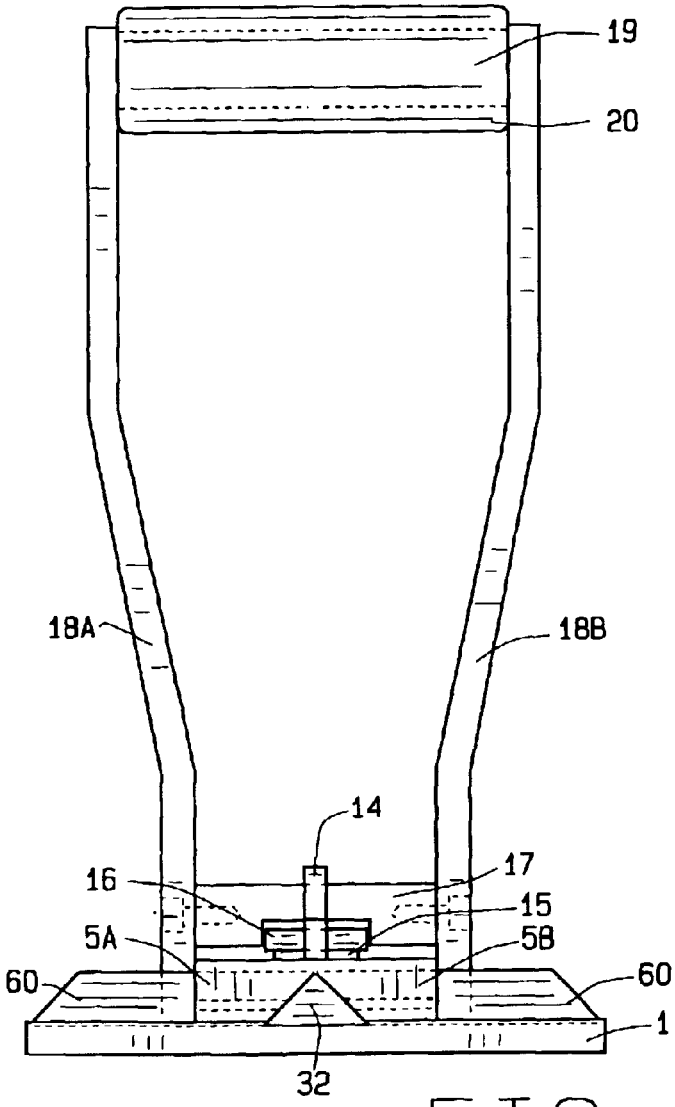
FIG. 7 is a view of the cutting blade and actuating mechanism employed with the device of FIG. 4.

Turning to FIG. 5, the first measurement assembly 9 generally includes a support arm 80 having an inverted L-shaped configuration, which extends outwardly from the shear blocks 5*a* and 5*b* of the mechanism. As indicated above, the measurement assembly 9 includes various adjustable stops indicated by the referenced numerals 129, 128, and 127. The stops are set along the arm 80 at varying distance according to the size of the item being framed. The first measurement assembly 9 is conventional, and is not described in detail. In operational use, once the indexing members 127 through 129 are set, a lineal 61 is secured in place so that the end of the piece of lineal 61 is near the cutting blade 32, so that the first notch may be formed in the lineal 61. The lineal 61 is advanced to the second length, corresponding to a dimension of item being framed, and the next notch is cut. Thereafter, the lineal 61 is advanced so that the last notch is moved to the next dimension of the item being framed, and the third notch is formed. The third notch then is advanced to the next dimension of the object being framed, and the final notch is cut. Thereafter, a hand tool is used to separate the carrier portion 77 from the remainder of the lineal 61.

Re-positional guides (goal posts) align and hold lineals in place when cutting large sections. These guides securely hold the lineal 61 in place after they have been notched, so they won't "fall off" the measuring bar and break apart. It is desirable to keep the lineal 61 in one piece, so when it is wrapped around the outside edge of item being framed, it will go on in one piece. If it does not go on in one piece, it diminishes the protection and sturdiness of the frame and detracts from the cosmetic look of the frame. On removal from the carrier, the now proper length edging is removed from the cutting assembly 1, and placed around the item being framed in a conventional manner.

One aspect of the present invention is that the first measuring assembly 9 may be positioned on either side of the blade 32. Aside from the ease of operation this arrangement provides, it also means that lineals 61 may be placed about an object in two different orientation. In addition, those skilled in the art will appreciate that a coating for the lineals 61 may be used to enhance the appearance of the framed article, if desired.

The device as shown in FIG. 3, includes the stand 100 having a base section 110. The base section, preferably, has a material holder 104 containing a series of cavities 103 attached to it. The holder 104 enables a user to store lineals 61 along the backside of the stand 100. This storage facilitates the ease of operation of the device, and creates an organized workstation which has all of the supplies and materials at hand to perform the production. In the preferred embodiment, the stand 100 is adjustable to accommodate different work heights for the assembly 1. Adjustment may be accomplished in a number of ways known to those skilled in the art.

Figure 14:
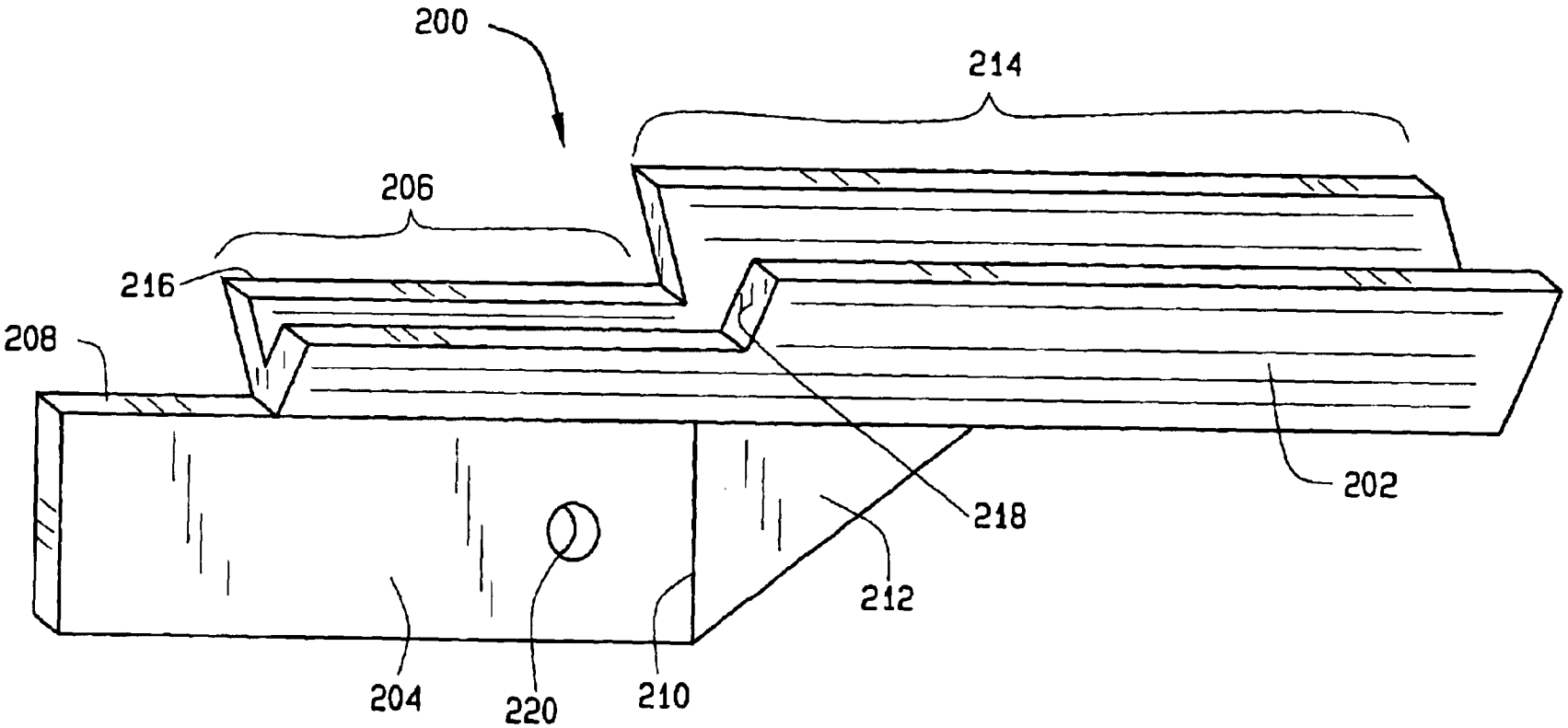
FIG. 14 is a perspective view of a of an reversible measuring system employed with the device of FIGS. 1–3.
Figure 15A:
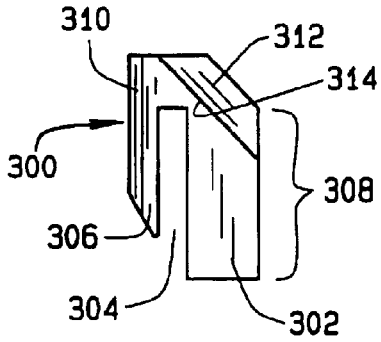
FIG. 15A is a side view of a first C-clamp employed with the reversible measuring system of FIG. 14.
Figure 15B:
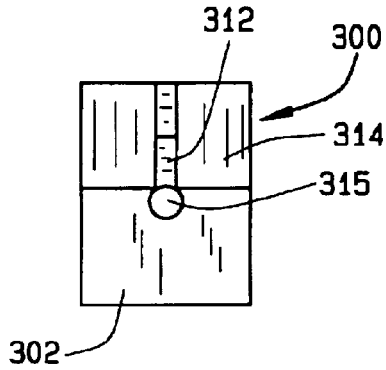
FIG. 15B is a front view of the C-clamp of FIG. 15A.

Turning to FIG. 14, a second measuring assembly 200 is shown generally in a perspective view. The measuring assembly 200 consists of a V-shaped measuring guide bar 202 mounted, adjacent one end, to a support bracket 204. A resected portion 206 of the V-shaped measuring guide bar 202 extends partially along the top 208 of the support bracket 204, and terminates above an edge 210 of the support bracket 204. At the edge 210 of the support bracket 204, an gusset 212 provides additional support for the remaining portion 214 of the measuring guide bar 202.

During use, the support bracket 204 of the second measuring assembly 200 is seated within a matching channel 7 in shear blocks 5*a* and 5*b*, which defines a support bracket receiver. Those of ordinary skill in the art will recognize that channel 7 is sized to receive the support bracket 204 from either the left side of shear blocks 5*a* and 5*b*, or from the right side of shear blocks 5*a* and 5*b*. When seated within the matching channel 7, an upper edge 216 of the resected portion 206 is braced against the face of the base plate 3, and a transition face 218, between the resected portion 206 and the remaining portion 214 of the measuring guide bar 202 abuts a side of the base plate 3. To secure the second measuring assembly 200 in position during use, a removable pin or lock mechanism 11 is passed through a bore 220 in the support bracket 204, and received in a corresponding opening 13 in the base plate 3. Those of ordinary skill in the art will recognize that the second measuring assembly 200 is symmetric, and reversible for mounting on either the left or right sides of the shear blocks 5*a* and 5*b*.

To facilitate the placement of the lineal 61 on the second measuring assembly 200, a pair of lineal stops 300, 400 show in FIGS. 15A, 15B, 16A, and 16B are adjustably secured to the V-shaped measuring guide bar 202. The short measuring guide 300 is configured to provide a measurement stop at a dimension corresponding to that of a short side on a product intended to be encased with the lineal border. The short measuring guide 300 consists of a rectangular body 302 having an slot 304 configured to clip onto one edge of the V-shaped measuring guide bar 202. When clipped onto an edge of the V-shaped measuring guide bar 202, a portion 306 of the stop 300 rests within the V-shaped measuring guide bar 202, and a second portion 308 hangs outside the V-shaped measuring guide bar 202. A lineal measurement stop 310 is centrally disposed on the first portion 306, while a measurement guide 312 is centrally disposed on a truncated edge 314 of the second portion 308. The measurement guide 312 forms a raised trapezoid. A threaded bore 315 receives a set screw (not shown) to secure the lineal stop 300 in place on the V-shaped measuring guide bar 202.

Figure 16A:
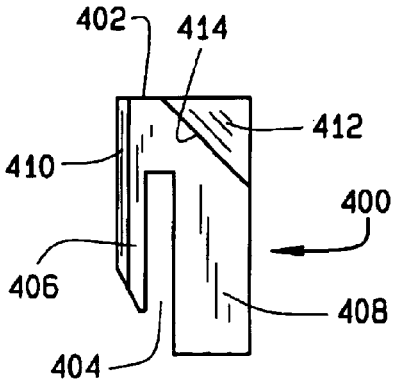
FIG. 16A is a side view of a first C-clamp employed with the reversible measuring system of FIG. 14.
Figure 16B:
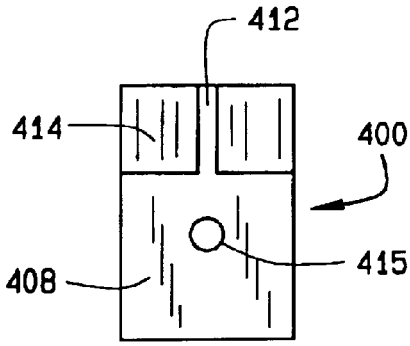
FIG. 16B is a front view of the C-clamp of FIG. 16A.

The long measuring guide 400, shown in FIGS. 16A and 16B is substantially identical to the short measuring guide 300. The long measuring guide 400 is configured to provide a measurement stop at a dimension corresponding to that of a long side on a product intended to be encased with the lineal border. The long measuring guide 400 consists of a rectangular body 402 having an slot 404 configured to clip onto one edge of the V-shaped measuring guide bar 202. When clipped onto an edge of the V-shaped measuring guide bar 202, a portion 406 of the stop 400 rests within the V-shaped measuring guide bar 202, and a second portion 408 hangs outside the V-shaped measuring guide bar 202. A lineal measurement stop 410 is centrally disposed on the first portion 406, while a measurement guide 412 is centrally disposed on a truncated corner 414 of the second portion 408. The measurement guide 412 forms a raised triangle. A threaded bore 415 receives a set screw (not shown) to secure the lineal stop 400 in place on the V-shaped measuring guide bar 202.

Figure 17:
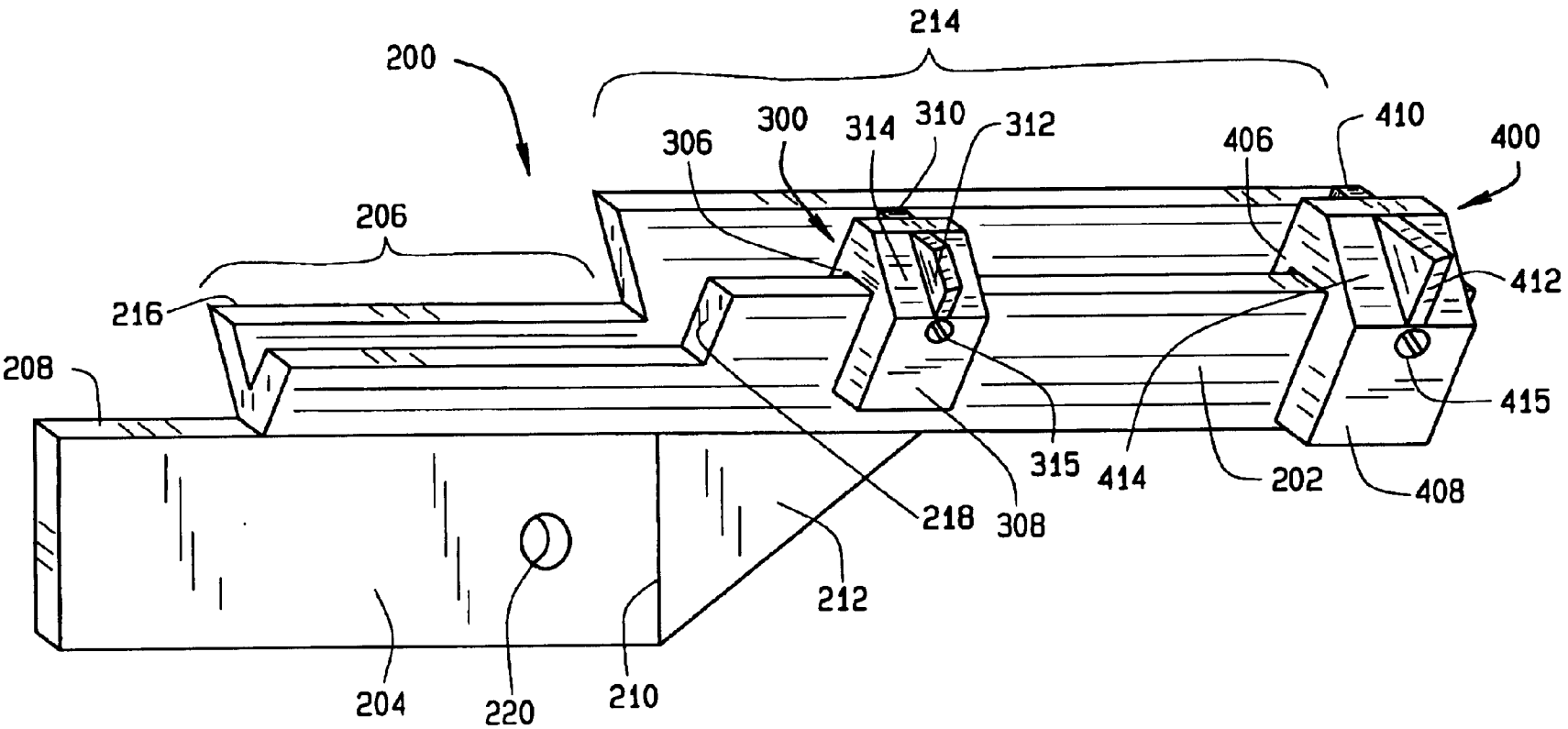
FIG. 17 is a perspective view of the reversible measuring system of FIG. 14 with the C-clamps of FIGS. 15 and 16 installed for use.

There are two important differences between the short and long measuring guides 300, 400. First, the long measuring guide 400 extends above the V-shaped measuring guide bar 202 further than the short measuring guide 300, and second, the measurement guide 410 forms a raised triangle, also extending above the measurement guide 310 of the short measuring guide 300. During use, as shown in FIG. 17, each lineal stop is positioned in place on the V-shaped measuring guide bar 202 using the product to be enclosed in the border as a guide. First, a corner of the short edge of the product is abutted against the center of the shear blocks 5A and 5B, parallel to the V-shaped measuring guide bar 202. The short measuring guide 300 is slid along the V-shaped measuring guide bar 202 until the trapezoidal measurement guide 312 abuts a second corner of the short edge of the product. The short measuring guide 300 is then secured in place using the set screw (not shown). Next, the process is repeated using the corners of the long side of the product and the long measuring guide 400. Since the long measuring guide 400 has a larger dimension than the short measuring guide 300, the product being measured is passed above the truncated edge 314 of the short measuring guide 300 to engage the measurement guide 412. Once the long measuring guide 400 is secured using a set screw, the cutting assembly and measurement assembly 200 is ready for use in cutting lineals 61. Each piece of lineal is placed in the measurement assembly abutting a lineal measurement stop 310 or 410, corresponding to whether a short side or a long side is being cut. The lineal 61 is now in proper position for actuation of the cutting blade as previously described.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A workpiece cutting device comprising:

a base member having a first measurement system mounting and a second measurement system mounting laterally opposed to said first measurement mounting system;

a reciprocating cutting blade movably mounted on said base member in a vertical orientation, said cutting blade equidistantly disposed between said first and second measurement system mountings;

a cutting blade actuator mounted to said base member, said cutting blade actuator cycling said reciprocating cutting blade between a retracted position and an extended position, said cutting blade actuator including a handle movable in an arc perpendicular to said base member in the direction of gravity between an upward position in relation to said base member and a lower position in relation to said base member;

a return mechanism biasing said handle toward said retracted position;

a jig secured to said base member for receiving said workpiece, said jig configured to permit cutting of said workpiece by said cutting blade;

a laterally reversible measurement system removably secured to at least one of said first and second measurement system mountings, said measurement system configured to facilitate the making of a plurality of sequential predetermined measured cuts in said workpiece;

wherein said laterally reversible measurement system includes a lineal guide;

a short measuring guide configured for adjustable placement about an edge of said lineal guide;

a long measuring guide configured for adjustable placement about an edge of said lineal guide said short measuring guide being closer to said cutting blade than said long measuring guide;

a support bracket disposed adjacent one end of said lineal guide; and wherein said support bracket is configured for laterally reversible mounting to each of said first and second measurement system mountings.

2. The workpiece cutting device of claim 1 adapted to frame a generally parallelogram shape, said measurement system configured to utilize said shape to facilitate the making of said plurality of sequential predetermined measured cuts in said workpiece.

3. The workpiece cutting device of claim 1 further including a clamp for releasably holding said workpiece with respect to said jig.

4. The workpiece cutting device of claim 1 wherein said lineal guide is a "V" shaped lineal support.

5. The workpiece cutting device of claim 1 wherein said base member is wall mounted.

6. The workpiece cutting device of claim 1 wherein said base member is mounted on a desktop stand.

7. The workpiece cutting device of claim 1 wherein said return mechanism is a spring.

8. The workpiece cutting device of claim 1 adapted for framing, wherein said cutting blade has an inverted "V" shape and has a "V" shaped cross section.

9. A cutting mechanism for cutting a workpiece comprising:

a base member having a receptacle for receiving the workpiece;

a clamping device, said clamping device positioned to hold the workpiece;

a cutting blade, the cutting having an inverted-V configuration and disposed in a vertical orientation;

a laterally reversible measurement system associated with said base, said measuring system configured to facilitate a plurality of sequential cuts in said workpiece by said cutting blade at predetermined measurements along said workpiece;

a lever operatively connected to said cutting blade, said lever operating said cutting blade vertically between a retracted position and a cutting position, said lever positioned in a plane perpendicular with respect to said base member for actuation in the direction of gravity as said cutting blade is operated between said retracted position to said cutting position;

a return mechanism associated with said lever, said return mechanism configured to return said lever and said cutting blade to said retracted position; and wherein said laterally reversible measurement system includes a "V" shaped lineal guide;

a short measuring guide configured for adjustable placement about an edge of said "V" shaped lineal guide;

a long measuring guide configured for adjustable placement about an edge of said "V" shaped lineal guide said short measuring guide being closer to said cutting blade than said long measuring guide;

a support bracket disposed adjacent one end of said "V" shaped lineal guide;

a support bracket receiver coupled to said base member and axially aligned with said cutting blade, said support bracket receiver configured to bilaterally receive a portion of said support bracket;

wherein said support bracket and said "V" shaped lineal guide are each configured for reversible lateral mounting to said support bracket receiver;

wherein each of said short and long measuring guides including an lineal measurement stop disposed inward in said "V" shaped lineal guide from said edge, and a measurement guide disposed outward of said "V" shaped lineal guide from said edge; and wherein said outwardly disposed measurement guide on at least one of said short and long measuring guides includes a truncated edge.

10. The cutting mechanism of claim 9 wherein said base member is configured for wall mounting.

11. The cutting mechanism of claim 6 wherein said return mechanism is a spring.

* * * * *

UNITED STATES PATENT AND TRADEMARK OFFICE

CERTIFICATE OF CORRECTION

PATENT NO. : 6,959,633 B2
APPLICATION NO. : 10/349533
DATED : November 1, 2005
INVENTOR(S) : Richard J. Brady It is certified that error appears in the above-identified patent and that said Letters Patent is hereby corrected as shown below:

Title Page, Item (57) ABSTRACT, line 9 after the word guide, delete “barn” and insert --bar--

Signed and Sealed this
Thirtieth Day of April, 2013

Teresa Stanek Rea
*Acting Director of the United States Patent and Trademark Office*